United States Patent [19]

Shiraishi et al.

[11] Patent Number: 4,866,974

[45] Date of Patent: Sep. 19, 1989

[54] METHOD OF CHANGING DIE ASSEMBLIES FOR PRESS MACHINE

[75] Inventors: Motoatsu Shiraishi; Ken Tazou; Masaru Sasagawa; Mitsuki Nakamura; Ryoichi Kageyama, all of Saitama, Japan

[73] Assignee: Honda Giken Kokyo Kabushiki Kaisha, Tokyo, Japan

[21] Appl. No.: 125,163

[22] Filed: Nov. 25, 1987

[30] Foreign Application Priority Data

Feb. 23, 1987 [JP] Japan ..... 62-39915

[51] Int. Cl.[4] ..... B21D 43/00; B21D 37/04; B21J 13/08

[52] U.S. Cl. ..... 72/405; 72/448

[58] Field of Search ..... 72/405, 422, 448, 446; 100/207, 229 R; 198/621; 414/752

[56] References Cited

U.S. PATENT DOCUMENTS

| | | | |
|---|---|---|---|
| 3,149,712 | 9/1964 | Soman . | |
| 3,190,464 | 6/1965 | Johansen et al. | 100/207 |
| 3,609,843 | 10/1971 | Fiegel, Jr. . | |
| 3,973,427 | 8/1976 | Shirao | 72/448 |
| 4,228,993 | 10/1980 | Cathers . | |
| 4,259,052 | 3/1981 | Imanishi . | |
| 4,428,221 | 1/1984 | Owens . | |
| 4,503,969 | 3/1985 | Baba | 198/621 |
| 4,519,309 | 5/1985 | Feirer et al. | 72/448 |
| 4,557,133 | 12/1985 | Mikusch et al. | 198/621 |
| 4,625,540 | 12/1986 | Yamada . | |
| 4,658,626 | 4/1987 | Yamada . | |

FOREIGN PATENT DOCUMENTS

| | | | |
|---|---|---|---|
| 57-134224 | 8/1982 | Japan . | |
| 60-174297 | 9/1985 | Japan . | |
| 61-16722 | 5/1986 | Japan . | |
| 62-2876 | 1/1987 | Japan . | |
| 984873 | 1/1983 | U.S.S.R. | 72/446 |

*Primary Examiner*—Daniel C. Crane

*Attorney, Agent, or Firm*—Birch, Stewart, Kolasch & Birch

[57] ABSTRACT

A press machine includes at least one mobile bolster movable with respect to the press machine, a plurality of die assemblies mounted on the mobile bolster and arranged in a row, a plurality of handling bars disposed in retracted positions between the die assemblies and movable, when one pressing cycle is completed, for gripping and transferring a plurality of workpieces successively through the die assemblies, and a plurality of handling bar gripping devices disposed in the retracted positions closely to the opposite sides of the side assemblies. A method of changing die assemblies comprises the steps of moving the mobile bolster out of the pressing machine, tilting the handling bar gripping devices away from the die assemblies, carrying the die assemblies away from the mobile bolster, carrying new die assemblies onto the mobile bolster in an order opposite to that in which the die assemblies were carried away from the mobile bolster, and returning the tilted handling bar gripping devices to upstanding positions after the new die assemblies are carried onto the mobile bolster.

4 Claims, 6 Drawing Sheets

METHOD OF CHANGING DIE ASSEMBLIES FOR PRESS MACHINE

BACKGROUND OF THE INVENTION

1. Field of the Invention

The present invention relates to a method of changing die assemblies for a press machine.

2. Description of the Relevant Art

Japanese Patent Application No. 62-2876 filed by the same assignee as the present invention discloses a press machine having a plurality of mobile bolsters movable in a direction normal to the direction in which workpieces are transferred. One or more die assemblies include a lower die or lower dies mounted on the upper surfaces of the mobile bolsters and arranged in a row along the workpiece transferring direction. Workpieces are placed on the lower dies and simultaneously pressed, e.g., drawn, trimmed, and punched, by upper dies supported on respective die holders and lowered toward the lower dies. Thereafter, the workpieces are simultaneously set on the next lower dies by a transfer device and then pressed again.

The workpiece transfer device comprises a plurality of hydraulic lifting/lowering units disposed on opposite sides of the die assemblies, vertically movable bars supported on the lifting/lowering units and vertically movable thereby, and feed bars movable back and forth along the vertically movable bars by suitable means. Between the feed bars, there are coupled and extend a plurality of handling bars each supporting a plurality of workpiece holders for holding workpieces under suction. During one pressing cycle, the handling bars are located in retracted positions between the die assemblies. Each time one pressing cycle is completed, the vertically movable bars and the feed bars are operated together to transfer the pressed workpieces to the respective next die assemblies. Handling bar gripping devices are mounted on each of the mobile bolsters at opposite ends thereof. When replacing the die assemblies, the handling bars are removed from the feed bars, and the opposite ends of the handling bars are gripped by the handling bar gripping devices. The mobile bolsters with the die assemblies and handling bar gripping devices being supported thereon are moved out of the press machine.

In the press machine, the die assemblies are closely positioned in order to make the overall size of the press machine compact and to shorten the time in which to transfer the workpieces. Since, however, the handling bar gripping devices are disposed between the closely arranged die assemblies, parts of the handling bar gripping devices and the workpiece holders are positioned in physical interference with the die assemblies as they are taken into and out of the press machine.

SUMMARY OF THE INVENTION

It is a major object of the present invention to provide a method of changing die assemblies for a press machine by tilting handling bar gripping devices away from the dies, so that the dies can be changed easily in a short period of time.

According to the present invention, there is provided a method of changing die assemblies in a press machine, the press machine including at least one mobile body movable with respect to the press machine, a plurality of die assemblies mounted on the mobile body and arranged in a row, a plurality of handling bars for gripping and transferring a plurality of workpieces successively through the die assemblies, a plurality of handling bar gripping devices for gripping the handling bars, tilting means for tilting the handling bar gripping devices, and carrying means for carrying the die assemblies away from and onto the mobile body. The method comprising the steps of moving the mobile body, the die assemblies, and the handling bar gripping devices with the handling bars gripped thereby out of the pressing machine, tilting the handling bar gripping devices away from the die assemblies with the tilting means, carrying the die assemblies away from the mobile body with the carrying means, carrying new die assemblies onto the mobile body in an order opposite to that in which the die assemblies were carried away from the mobile body, and returning the tilted handling bar gripping devices to upstanding positions after the new die assemblies are carried onto the mobile body.

The above and further objects, details and advantages of the present invention will become apparent from the following detailed description of a preferred embodiment thereof, when read in conjunction with the accompanying drawings.

DETAILED DESCRIPTION OF THE PREFERRED EMBODIMENT

Figure 1:
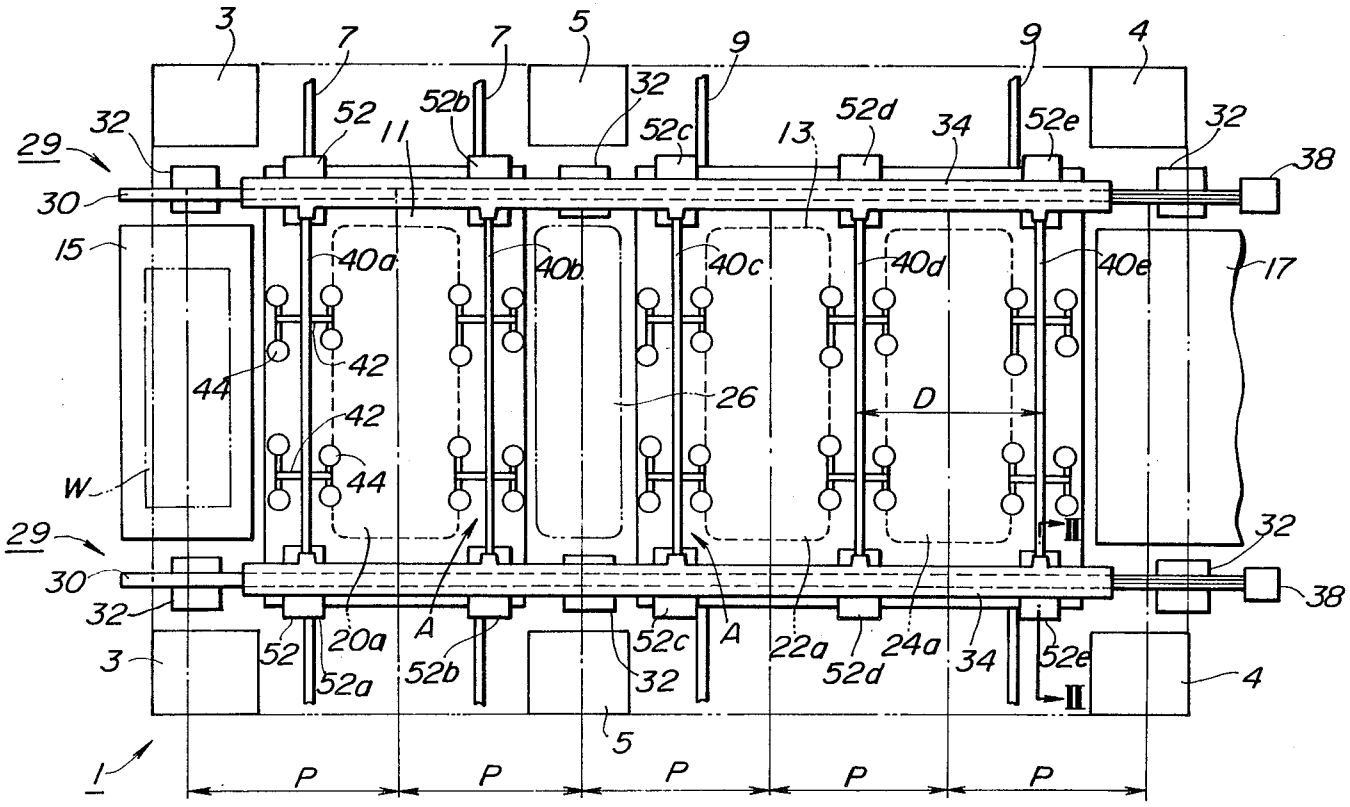
FIG. 1 is a fragmentary plan view of a press machine.
Figure 5:
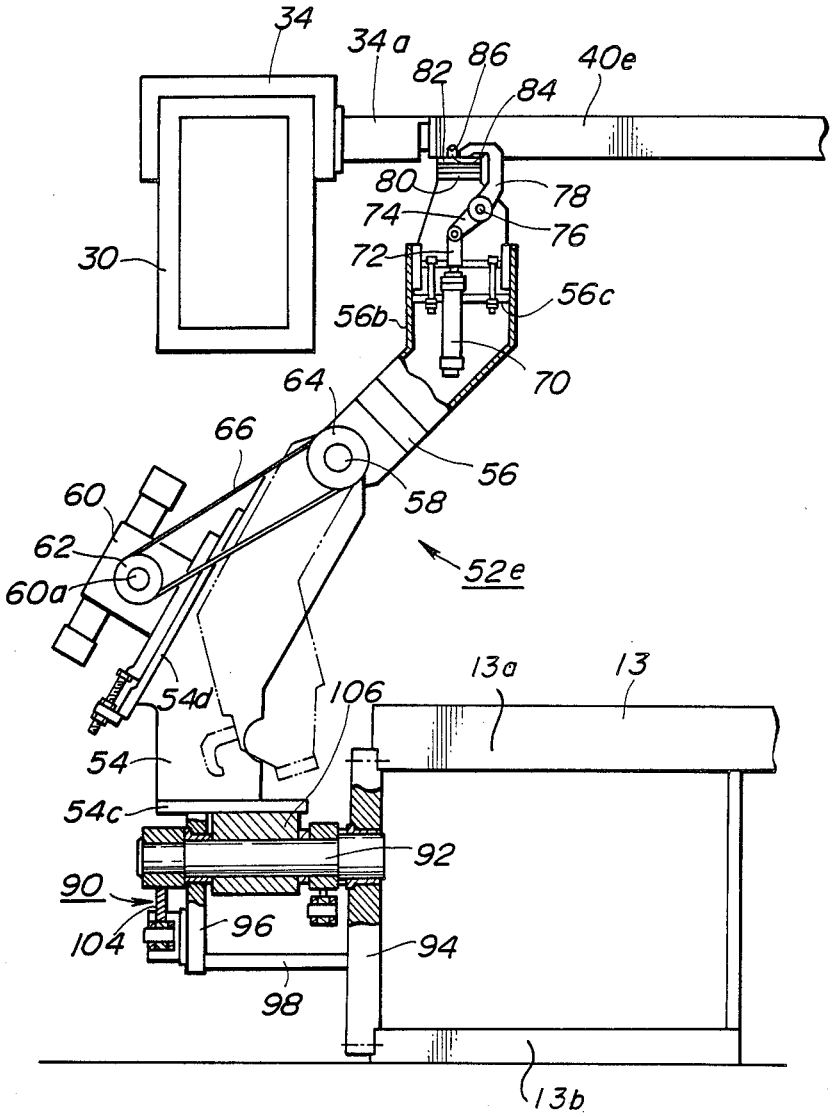
FIG. 5 is a side elevational view, partly in cross section, of the handling bar gripping device illustrated in FIG. 4.

As shown in FIG. 1, a press machine 1 has four upstanding corner columns 3, 4 and two upstanding central columns 5 each positioned between one pair of corner columns 3, 4. A pair of guide rails 7 is disposed between the corner columns 3 and the central columns 5 and extends in a direction normal to the longitudinal direction of the press machine 1, i.e., to the direction in which a workpiece W is transferred. A pair of guide rails 9 is disposed between the corner columns 4 and the central columns 5 and extends in a direction normal to the longitudinal direction of the press machine 1, i.e., to the direction in which a workpiece W is transferred. First and second mobile bolsters 11, 13 are movable along the respective pairs of guide rails 7, 9 into and out of the press machine 1 by suitable drive means. As shown in FIGS. 1, 14 and 5, the second mobile bolster 13 has upper and lower rectangular plate 13*a*, 13*b* connected by side vertical plates 13*c*. The mobile bolster 13 may have a plurality of wheels (not shown) for rolling engagement with the guide rails 7, 9. Alternatively, the mobile bolster 13 may be in sliding engagement with the guide rails 7, 9. The first mobile bolster 11 is substantially identical to the second mobile bolster, except for physical size, and thus will not be described herein for the purpose of simplicity. A loading station 15 is located upstream (leftward in FIG. 1) of the first mobile bolster 11 with respect to the workpiece transferring direction. A workpiece W to be pressed is supplied to the loading station 15. An unloading station 17 is located downstream (rightward in FIG. 1) of the second mobile bolster 13 with respect to the workpiece transferring direction. A workpiece W that has been 26 pressed is unloaded from the unloading station 17.

A lower drawing die 20*a* is mounted on the upper surface of the first mobile bolster 11. A lower trimming die 22*a* and a lower punching die 24*a* adjacent thereto are mounted on the upper surface of the second mobile bolster 13. These lower dies 20*a*, 22*a*, 24*a* are arranged in a row along the workpiece transferring direction. A workpiece stock station 26 for temporarily placing a workpiece W thereon is disposed between the first and second mobile bolsters 11, 13 and also between the central columns 5. The longitudinal central lines of the stations 15, 17, 26 and the longitudinal central lines of the lower dies 20*a*, 22*a*, 24*a* on the first and second mobile bolsters 11, 13 disposed adjacent to the respective stations are equally spaced at intervals or distances P. An upper drawing die (not shown) is supported on a die holder (not shown) which is vertically movable along the corner columns 3, 4 and the central columns 5, and an upper trimming die (not shown) and an upper punching die 24*b* (FIG. 7) are supported on respective die holders which are vertically movable along the corner columns 3, 4 and the central columns 5.

A workpiece transfer device 29 has two vertically movable bars 30 extending along the workpiece transferring direction and disposed between the corner columns 3, 4 and the central columns 5 and the first and second mobile bolsters 11, 13. The vertically movable bars 30 are supported on and vertically movable by a plurality of lifting/lowering units 32. Feed bars 34 are mounted respectively on the vertically movable bars 30 and axially slidable thereon by respective feed bar moving units 38. The vertical movement of the vertically movable bars 30 and the sliding movement of the feed bars 34 are related to the vertical movement of the upper dies through a link mechanism and cams (not shown).

A plurality of handling bars 40*a* through 40*e* extend between and are joined to the feed bars 34 in a ladder-like configuration. Adjacent two of the handling bars 40*a* through 40*e* are spaced from each other by a distance D which is equal to the distance P between adjacent two of the stations 15, 17, 26 and the lower dies 20*a*, 22*a*, 24*a*. A plurality of suction members, i.e., vacuum cups 44 serving as workpiece holders are supported on each of the handling bars 40*a* through 40*e* by means of detachable support members 42 for holding workpieces W under suction. In the illustrated embodiment, a total of eight vacuum cups 44 are mounted on each handling bar.

When workpieces W are pressed, the handling bars 40*a* through 40*e* are located in respective retracted positions A on both sides of the lower dies 20*a*, 22*a*, 24*a* so that the handling bars will not interfere with the pressing operation. After the pressing process has been completed, the upper dies are elevated by the die holders, and then the feed bars 34 and the vertically movable bars 30 are elevated by the lifting/lowering units 32.

The feed bars 34 are moved to the left in FIG. 1 by the feed bar moving units 38 by a distance ($\frac{1}{2}$P) which is half the distance P between the central line of the loading station 15 and the central line of the first mobile bolster 11. The leftward movement of the feed bars 34 is followed by downward movement, caused by the lifting/lowering units 32, of the vertically movable bars 30 and the feed bars 34 to a prescribed position. Now, the vacuum cups 44 mounted on the handling bar 40*a* attract and hold a workpiece W to be pressed which is positioned on the loading station 15, and the vacuum cups 44 mounted on the handling bar 40*b* attract and hold a workpiece W on the lower drawing die 20*a*. At the same time, the vacuum cups 44 mounted on the handling bar 40*c* attract and hold a workpiece W on the workpiece stock station 26, and the vacuum cups 44 mounted on the handling bars 40*d*, 40*e* attract and hold workpieces W respectively on the lower trimming die 22*a* and the lower punching die 24*a*.

Thereafter, all of the handling bars 40*a* through 40*e* with the respective workpieces W held thereby are lifted by the lifting/lowering units 32. The feed bars 34 are moved downstream the distance P by the moving units 38. When the handling bars 40*a* through 40*e* have been moved to respective positions directly above the lower die 20*a*, the workpiece stock station 26, the lower dies 22*a*, 24*a*, and the unloading station 17, the vertically movable bars 30 are lowered to set the workpieces W on the lower die 20*a*, the workpiece stock station 26, the lower dies 22*a*, 24*a*, and the unloading station 17, respectively. Thereafter, the handling bars 40*a* through 40*e* are returned to the retracted positions A by the lifting/lowering units 32 and the feed bar moving units 38. The upper dies are then lowered with their die holders to press those workpieces W set on the respective lower dies 20*a*, 22*a*, 24*a*.

Figure 2:
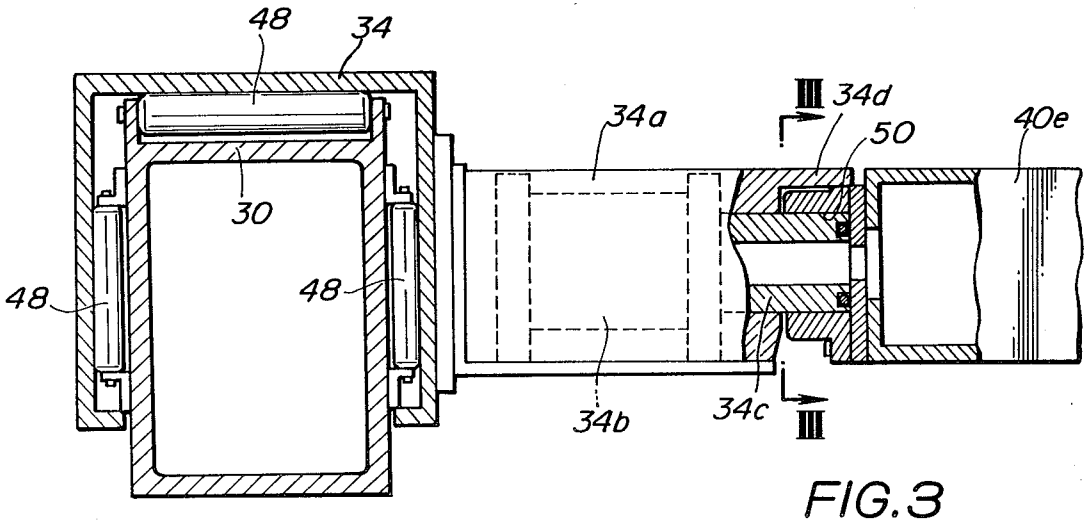
FIG. 2 is an enlarged cross-sectional view taken along line II—II of FIG. 1, showing the structure by which a feed bar and a handling bar are interconnected.
Figure 3:
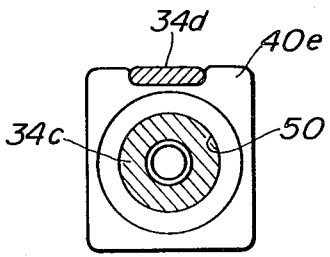
FIG. 3 is a cross-sectional view taken along line III—III of FIG. 2.

As shown in FIGS. 2 and 3, the feed bar 34 is rollingly movable on the vertically movable bar 30 by means of three rollers 48 and has a plurality of connectors 34*a* (only one shown in FIGS. 2 and 3) on an inner side thereof. In the connector 34*a*, there is mounted a cylinder 34*b* having an axially movable rod 34*c*. The handling bar 40*e*, for example, has a recess 50 defined in each of its opposite ends. When the rod 34*c* is extended, its tip end is inserted into the corresponding recess 50, thereby coupling the connector 34*a* and the handling bar 40*e* to each other. The connector 34*a* has a ridge 34*d* projecting from its distal end for engaging the handling bar 40*a* for limiting its height and rotation.

There are provided a total of ten handling bar gripping devices, generally designated by the reference numeral 52 (more specifically 52*a* through 52*e*) in FIG. 1. Four of the handling bar gripping devices are associated with the first mobile bolsters 11, whereas the remaining six handling bar gripping devices are associated with the second mobile bolsters 13. The handling bar gripping devices 52*a* through 52*e* are identical in structure. Therefore, one of the handling bar gripping devices 52*e* will be described in detail by way of example. As shown in detail in FIGS. 4 and 5, the handling bar gripping device 52*e* comprises a body 54 and a swing arm 56 angularly movably mounted on the body 54 by a support shaft 58 and gripping one end of the handling bar 40*e*, for example. More specifically, the body 54 of the handling bar gripping device 52*e* comprises two substantially V-shaped side plates 54a spaced from and parallel to each other, a bearing 54b joining the upper ends of the side plates 54a and supporting the opposite ends of the support shaft 58, and a bottom plate 54c joining the lower ends of the side plates 54a. The side plates 54a have slanted upper edges, respectively, to which there is secured an attachment plate 54d with a drive unit 60 fixedly mounted thereon.

The swing arm 56 comprises two spaced side plates 56a and is of a substantially V shape slightly smaller than the V-shaped configuration of the body 54, the swing arm 56 being coupled at its lower end to the support shaft 58. As indicated by the broken lines in FIG. 5, the swing arm 56 can be accommodated in a space between the side plates 54a of the body 54 during a pressing process. For detaching the handling bar 40e from the feed bar 34, the swing arm 56 is turned counterclockwise (FIG. 5) about the support shaft 58 to the solid-line position in order to support the handling bar 40e. The swing arm 56 is turned by the drive unit 60 which produces rotative power that is transmitted to the support shaft 58 by means of a power transmitting device. The power transmitting device comprises a sprocket 62 fixed to an output shaft 60a of the drive unit 60, a sprocket 64 fixed to one end of the support shaft 58, and a chain belt 66 trained around the sprockets 62, 64. The rotative power from the drive unit 60 is transmitted from the sprocket 62 through the chain belt 66 to the sprocket 64 for turning the support shaft 58 and hence the swing arm 56.

Two attachment plates 56b are coupled to and extend between upper portions of the side plates 56a. A hydraulic cylinder 70 is positioned between and supported on the attachment plates 56b by means of a plurality of support members 56c. The hydraulic cylinder 70 has an axially movable rod 72 with its distal end pivotally coupled to a bracket 74 fixed to a pivot pin 76. The pivot pin 76 has its opposite ends rotatably supported on the side plates 56a and coupled to ends of respective fingers 78. A support plate 80 is attached to the upper end of the swing arm 56. When the swing arm 56 is turned upwardly, the support plate 80 engages one of bearing plates 82 fixed to the respective opposite ends of the handling bar 40e. At this time, two positioning pins 84 on the support plate 80 are inserted into respective holes defined in the bearing plate 82 thereby to position the swing arm 56 with respect to the handling bar 40e. The hydraulic cylinder 70 is now operated to retract the rod 72 for thereby turning the fingers 78 into pressing engagement with the upper surface of the bearing plate 82 to press the bearing plate 82 downwardly against the support plate 80. The handling bar 40e is thus securely gripped and held in position by the swing arm 56.

Figure 6:
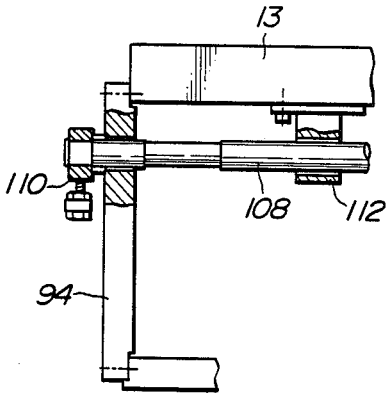
FIG. 6 is a cross-sectional view taken along line VI—VI of FIG. 4.

A tilting device, generally denoted at 90, serves to support and tilt each of the handling bar gripping devices 52 downwardly (FIG. 7) away from dies when the dies are to be changed. One of the tilting devices 90 which is associated with the second mobile bolster 13 and one handling bar gripping device 52e will be described below. The tilting device 90 has an attachment plate 94 fixed to a side of the second mobile bolster 13, a support shaft 92 having one end rotatably supported by a bearing on the attachment plate 94 and the other end rotatably supported by a bearing on a vertical plate 96 coupled to the attachment plate 94 by a horizontal plate 98, and a hydraulic cylinder 100 mounted on the vertical plate 96. The hydraulic cylinder 100 has an axially movable rod 102 coupled to the support shaft 92 by means of a swing arm 104. The support shaft 92 has a connector 106 to which the bottom plate 54c of the body 54 of the handling bar gripping device 52e is secured. The support shaft 92 is connected to one end of a transmission rod 108 through a link mechanism 110. As shown in FIG. 6, the transmission rod 108 is rotatably supported by a bearing 112 mounted on the lower surface of the second mobile bolster 13. The other end of the transmission rod 108 is coupled via a link mechanism (not shown) to the support shaft (not shown) of the opposite handling bar gripping device 52e.

Figure 4:
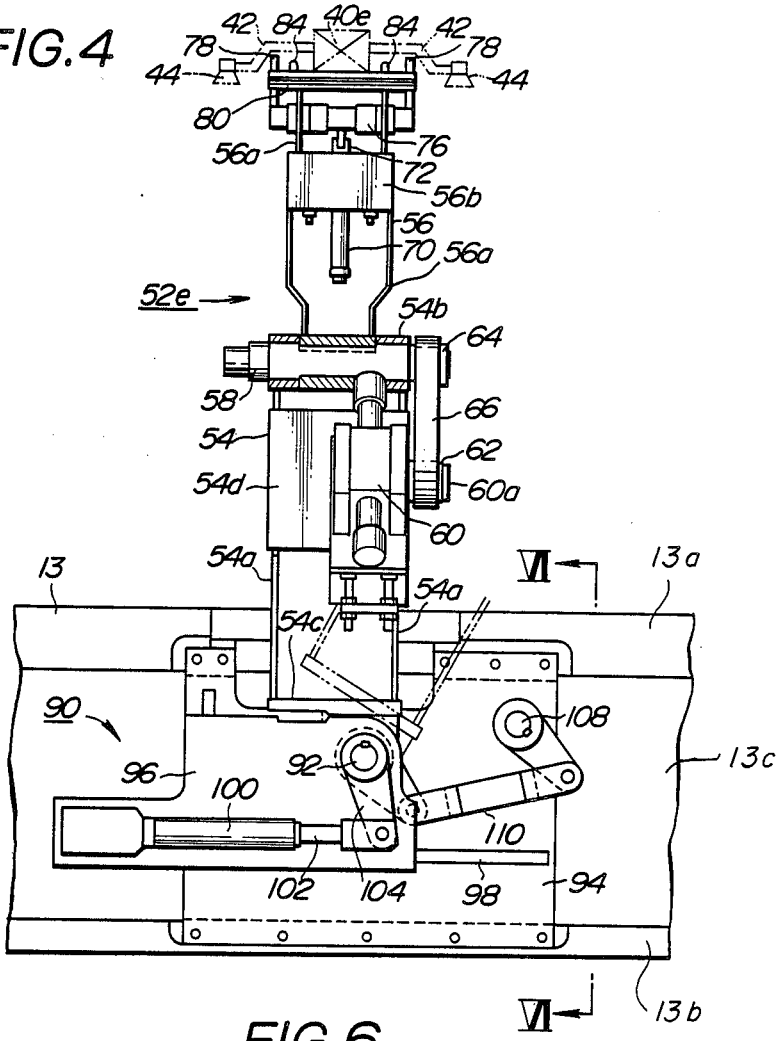
FIG. 4 is a front elevational view of a handling bar gripping device in the press machine shown in FIG. 1.

When the rod 102 is retracted from the position of FIG. 4, the swing arm 104 is turned clockwise and so is the support shaft 92 about its own axis. As the support shaft 92 is turned clockwise, the handling bar gripping device 52e is tilted to the right (FIG. 4) away from the dies as indicated by the broken lines. At this time, the rotation of the support shaft 92 is transmitted via the link mechanism 110 to the support shaft of the opposite handling bar gripping device 52e, which is therefore also tilted in the same direction.

Operation will hereinafter be described. The handling bars 40a through 40e located in their respective retracted positions A after a pressing process are lowered a prescribed distance by the lifting/lowering units 32. Then, the die holders holding the upper dies are lowered, and the upper and lower dies are aligned and mated with each other. Thereafter, the upper dies are released from the die holders thereof and placed on the lower dies.

Each of the handling bar gripping devices 52e is operated in the manner described above to turn the swing arm 56 from the broken-line position to the solid-line position for gripping the handling bar 40e, as shown in FIG. 5. Thereafter, the rod 34c of the cylinder 34b is retracted to disconnect the connector 34a of the feed bar 34 from the handling bar 40e. The handling bar 40e is now released from the feed bar 34, and only held by the handling bar gripping device 52e. The vertically movable bar 30 is lifted to a position out of physical interference with movement of the handling bar 40e and/or the dies 24a, 24b, and the second mobile bolster 13 is moved along the guide rails 9 to deliver the upper and lower dies 24a, 24b which jointly constitute a punching die assembly 24, the handling bar 40e, and the handling bar gripping devices 52e out of the press machine 1. The other dies 20a, 20b, 22a, 22b together with their associated parts are also delivered out of the press machine 1 in the same manner.

Figure 7:
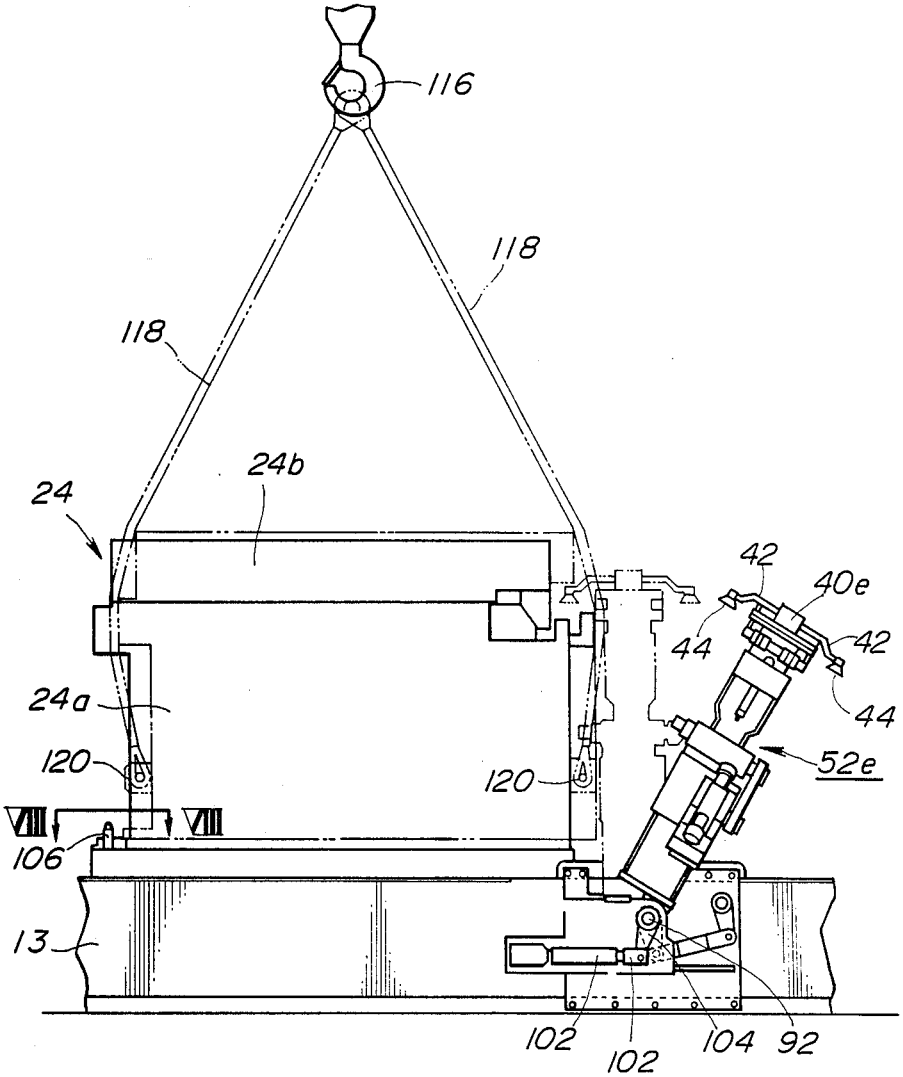
FIG. 7 is a fragmentary elevational view showing the manner in which a die assembly is carried away from a mobile bolster.
Figure 8:
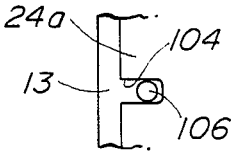
FIG. 8 is a cross-sectional view taken along line VIII—VIII of FIG. 7.

A process of carrying an existing die assembly away from a mobile bolster and placing a new die assembly onto the mobile bolster will be described with reference to FIGS. 7 through 9.

The rod 102 of the hydraulic cylinder 100 is retracted to turn the support shaft 92 clockwise for thereby tilting the handling bar gripping devices 52e in order to move the workpiece holders or vacuum cups 44 out of the way of the lower die 24a of the punching die assembly 24, so that the punching die assembly 24 will smoothly be hung out of physical interference with the vacuum cups 44. As best shown in FIG. 8, the lower die 24a has a plurality of slots 104 (only one shown) defined in a side of the bottom thereof. During a pressing process, a plurality of positioning pins 106 (only one shown) mounted on the upper surface of the second mobile bolster 13 engage in the respective slots 104 to position the punching die assembly 24 on the second mobile bolster 13.

With the handling bar gripping devices 52*e* thus tilted, a hanger unit 110 (FIG. 9) is moved along a guide rail 112 to a position substantially directly above the die assembly 24, and upper ends of a plurality of hanging wires 118 are engaged by a hook 116 on the lower end of a support wire 114 of the hanger unit 110, whereas the lower ends of the hanging wires 118 are engaged by respective pins 120 on the lower die 24*a*. The hanger unit 110 is then moved to the right in FIG. 7 to release the positioning pins 106 out of the slots 104. Since the handling bar gripping devices 52*e* are already tilted to the right, the rightward movement of the die assembly 24 is not obstructed by the handling bar gripping devices 52*e*. Thereafter, the support wire 114 is wound up to elevate the die assembly 24 off the second mobile bolster 13 and carry the die assembly 24 away from the second mobile bolster 13.

The trimming die assembly, jointly constituted by the lower trimming die 22*a* and the upper trimming die, is carried away in the same manner. More specifically, the handling bar gripping devices 52*d* located on the right-hand side (FIG. 9) of the die assembly is tilted to the right, and the hanger unit 110 is moved to a position directly above the die assembly. With the hanger unit 110 coupled to the die assembly, the hanger unit 110 is slightly shifted to the right to displace the positioning pins 106 out of the slots 104. Thereafter, the support wire 114 is wound up to lift and carry the die assembly away from the second mobile bolster 13. Finally, the drawing die assembly of the lower drawing die 20*a* and the upper drawing die is carried away from the first mobile bolster 11 in the same manner as described above.

New die assemblies are successively placed onto the first and second mobile bolsters 11, 13 in the opposite order to that in which the punching, trimming, and drawing die assemblies have been carried away. For the sake of brevity, only a process of placing a new die assembly on the second mobile bolster 13 will be described below. The other new die assemblies are placed on the first and second mobile bolsters 11, 13 in the same way.

Figure 9:
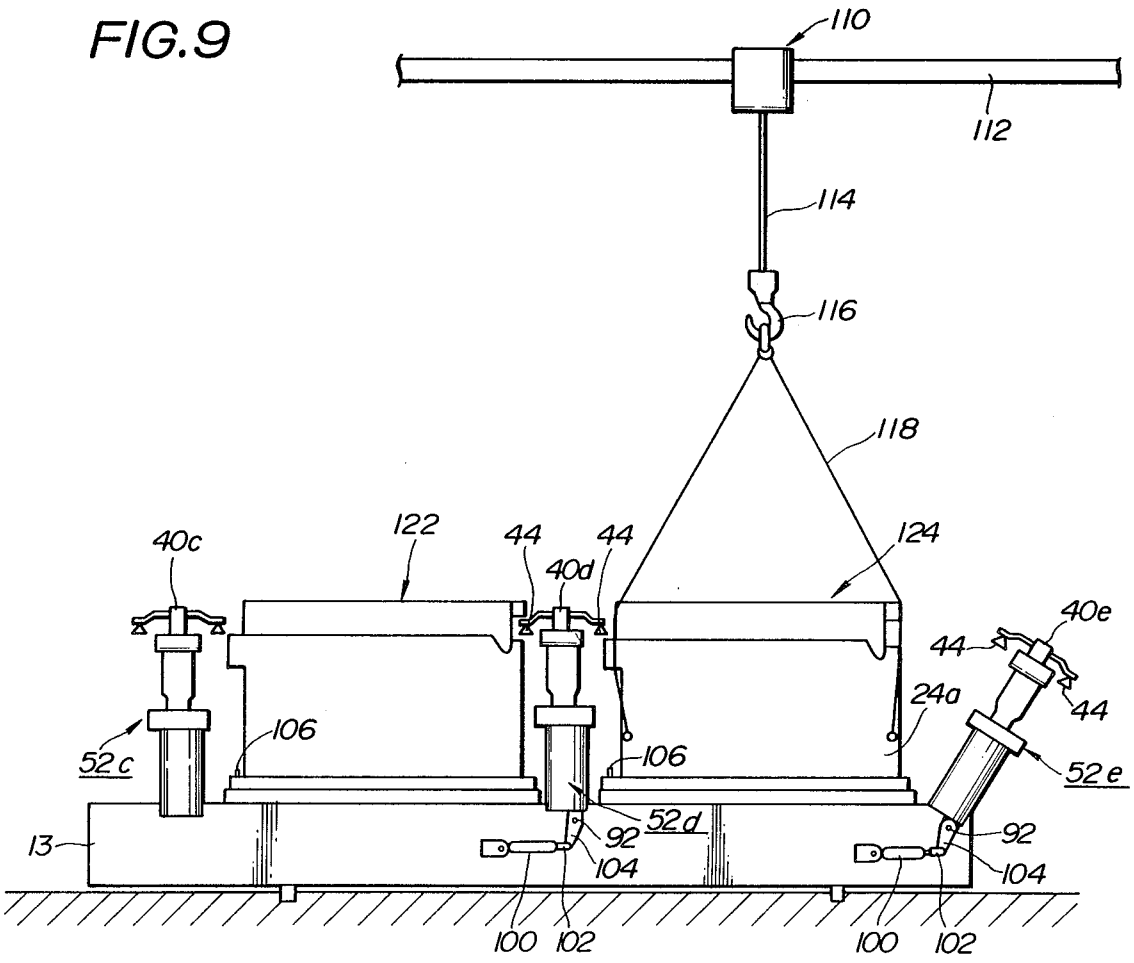
FIG. 9 is a fragmentary elevational view showing the manner in which a die assembly is placed onto a mobile bolster.

As shown in FIG. 9, a new trimming die assembly 122 is placed on and fixed to the second mobile bolster 13, and the handling bar gripping devices 52*d* are turned to their upstanding position. Then, a new punching die assembly 124 is hung by the hanger unit 110 through the wires 114, 118 and moved over the second mobile bolster 13 just above the position where the old punching die assembly 24 were located. The support wire 114 is then unwound to lower the new die assembly 124 onto the second mobile bolster 13. Thereafter, the hanger 110 is slightly moved to the left (FIG. 9) to insert the positioning pins 106 into corresponding slots of the die assembly 124 for positioning the die assembly 124 on the second mobile bolster 13. The die assembly 124 is firmly fixed to the second mobile bolster 13 by suitable means such as bolts. The rod 102 of the hydraulic cylinder 100 is then extended to turn the swing arm 104 counterclockwise for thereby returning the handling bar gripping devices 52*e* to their upstanding position.

Although there has been described what is at present considered to be the preferred embodiment of the present invention, it will be understood that the invention may be embodied in other specific forms without departing from the spirit or essential characteristics thereof. The present embodiment is therefore to be considered in all aspects as illustrative, and not restrictive. The scope of the invention is indicated by the appended claims rather than by the foregoing description.

We claim:

1. A method of changing die assemblies in a press machine, said press machine including at least one mobile body on which said die assemblies are arranged in adjacent relation to one another, said mobile body being movable to and from the press machine along guide rails which extend transversely to a longitudinal axis of the press machine, a plurality of handling bars adapted to transfer a plurality of workpieces from one of said die assemblies to another, said workpieces being moved along the longitudinal axis of the press machine, means for moving said handling bars between the die assemblies, a plurality of pairs of handling bar gripping devices arranged in line along the longitudinal axis of the press machine and normally placed in an upstanding position relative to the mobile body, means from tilting said handling bar gripping devices about an axis which extends transversely to the longitudinal axis of the press machine, said tilting means being directly mounted to the mobile bolster, and means for carrying said die assemblies out of and onto the mobile body, said method comprising the steps of:

(a) moving said mobile body out of the press machine along the guide rails;
(b) gripping the handling bars with the handling bar gripping device;
(c) tilting the handling bars and the handling bar gripping device from the upstanding position to a tilted position to move the gripping device in a direction away from the die assembly;
(d) carrying the die assembly out of the mobile body by said carrying means;
(e) continuing said tilting and said carrying alternately until all of the existing die assemblies have been carried out of the mobile body;
(f) carrying a new die assembly onto the mobile body;
(g) returning said handling bar gripping device to its initial upstanding position; and
(h) continuing said carrying and said returning alternately until all of the existing die assemblies have been replaced with new die assemblies.

2. The method of claim 1, wherein said new die assemblies are carried onto the mobile body in an order opposite to that in which the existing die assemblies are carried out of the mobile body.

3. A method of changing die assemblies in a press machine, said press machine including at least one mobile body on which said die assemblies are arranged in adjacent relation to one another, said mobile body being movable to and from the press machine along guide rails which extend transversely to a longitudinal axis of the press machine, a plurality of lateral handling bars having a plurality of workpiece holders detachably mounted thereto and adapted to transfer said workpieces from one of said die assemblies to another, said workpieces being moved along the longitudinal axis of the press machine, means for moving said handling bars between the die assemblies, said means including a pair of elongated bars extending substantially through the press machine and placed near both sides of the die assemblies, said pair of bars being vertically movable by lifters, and a corresponding pair of elongated feed bars slidably movable on said bars, each of said lateral handling bars being detachably connected between the feed bars, a plurality of pairs of handling bar gripping devices arranged in line along the longitudinal axis of the press machine and tiltably mounted to said mobile body, said handling bar gripping devices being normally held in an upstanding position, tilting means for tilting said handling bar gripping device about an axis which extends transversely to the longitudinal axis of the press machine, and means for carrying said die assemblies out of and onto the mobile body, said method comprising the steps of:

(a) gripping said handling bars by said handling bar gripping devices;

(b) disconnecting said handling bars from the feed bars;

(c) moving said vertically movable bars together with said feed bars upwardly of the die assemblies;

(d) moving said mobile body out of the press machine along the guide rails;

(e) tilting the handling bars and the handling bar gripping device from an upstanding position to a tilted position to move the gripping device in a direction away from the die assembly;

(f) carrying the die assembly out of the mobile body by said carrying means;

(g) continuing said tilting and said carrying alternately until all of the existing die assemblies have been carried out of the mobile body;

(h) carrying a new die assembly onto the mobile body;

(i) returning said handling bar gripping device to its initial upstanding position; and (u) continuing said carrying and said returning alternately until all of the existing die assemblies have been replaced with new die assemblies.

4. The method of claim 3, wherein said new die assemblies are carried onto the mobile body in an order opposite to that in which the existing die assemblies are carried out of the mobile body.

* * * * *